US005500631A

United States Patent [19]

Negus

[11] Patent Number: 5,500,631

[45] Date of Patent: Mar. 19, 1996

[54] MAGNETIC SOCKET HOLDER

[75] Inventor: Joel A. Negus, Clarinda, Iowa

[73] Assignee: Lisle Corporation, Clarinda, Iowa

[21] Appl. No.: 271,868

[22] Filed: Jul. 7, 1994

Related U.S. Application Data

[63] Continuation-in-part of Ser. No. 72,478, Jun. 4, 1993, Pat. No. 5,343,181, which is a continuation-in-part of Ser. No. 1,534, Jan. 7, 1993, Pat. No. 5,313,181.

[51] Int. Cl.[6] ..... H01F 7/20; A45F 5/00; A45C 11/26; B25B 11/00

[52] U.S. Cl. ..... 335/285; 335/286; 224/183; 206/818; 206/350; 269/8

[58] Field of Search ..... 335/285, 286, 335/302, 306; 279/128; 51/362; 269/8; 224/183; 206/564, 818; 81/125; 24/303

[56] References Cited

U.S. PATENT DOCUMENTS

| | | | |
|---|---|---|---|
| 3,059,767 | 10/1962 | Chalfin | 206/84 |
| 3,598,900 | 8/1971 | Drake . | |
| 3,654,047 | 4/1972 | Berkowitz | 161/7 |

*Primary Examiner*—Leo P. Picard
*Assistant Examiner*—Stephen T. Ryan
*Attorney, Agent, or Firm*—Banner & Allegretti, Ltd.

[57] ABSTRACT

A magnetic socket holder includes a molded plastic tray with a center bar having laminated keeper plates and bar magnets positioned therein to define pole pieces which permit the forming of magnetic circuits that when closed enhance the holding action of sockets in the tray, as well as holding action of the tray on a magnetizable surface. An integrally molded handle is provided for carrying the tray and sockets.

8 Claims, 4 Drawing Sheets

MAGNETIC SOCKET HOLDER

CROSS REFERENCE TO RELATED APPLICATION

This is a Continuation-In-Part of application Ser. No. 08/072,478, filed Jun. 4, 1993 now U.S. Pat. No. 5,343,181 which is a Continuation-In-Part of application Ser. No. 08/001,534, filed Jan. 7, 1993 now U.S. Pat. No. 5,313,181.

BACKGROUND OF THE INVENTION

This invention relates to a magnetic socket holder and, more particularly, to a magnetic socket holder which utilizes a single closed loop magnetic circuit to hold each individual socket positioned in the holder and a plurality of such circuits to provide a means for mounting the socket holder on a magnetizable surface.

Heretofore, there have been various constructions combining a molded, non-magnetic material with magnets to thereby provide a holder for metal sockets. Pierce, U.S. Pat. No. 3,405,377 discloses such a construction which includes a series of parallel bores in a non-magnetic material. A magnet is positioned at the bottom of each bore and arranged so that a magnetic circuit is completed by insertion of a socket in the bore. Miller, in U.S. Pat. No. 4,591,817, discloses a socket holder which includes armatures or plates that laminate a magnetic material to thereby define an assembly for holding sockets. Anderson, in U.S. Pat. No. 4,802,580 discloses a similar construction wherein parallel plates sandwich a magnetic material. A third, parallel plate is positioned to facilitate alignment of the items being retained. Each of these references is incorporated herewith by reference.

While the above-identified constructions are quite useful and provide a means for storing metal sockets in a convenient and easily accessible fashion, there has remained a need for an improved apparatus for storing and maintaining sockets made of a magnetizable material.

SUMMARY OF THE INVENTION

Briefly, the present invention comprises an improved magnetic socket holder fabricated from a molded tray of non-magnetic material in combination with a pair of bar magnets laminated with pole pieces or armatures. The bar magnets are arranged along a center rib in the molded tray. One of the bar magnets serves as a source of magnetism for holding the sockets in the tray by magnetizing the keeper plates which are positioned to complete a single magnetic circuit with each socket. The second bar magnet is fabricated to provide a plurality of magnetic circuits designed to hold the tray itself on a magnetizable surface.

Thus, it is an object of the invention to provide an improved magnetic socket holder.

A further object of the invention is to provide a magnetic socket holder which is easily assembled and economical to manufacture.

Another object of the invention is to provide a magnetic socket holder which utilizes one or more bar type magnets in combination with a non-magnetic molded tray to provide a holder for sockets of a magnetizable material.

Still another object of the invention is to provide an improved magnetic socket holder which may be easily attached in any desired orientation to a magnetizable surface while retaining sockets tightly in the holder and providing ease of access to the sockets.

Yet another object of the invention is to provide an improved magnetic socket holder which utilizes magnetic circuits in a unique manner to retain both the sockets individually in the holder and to mount the holder itself on a magnetizable surface.

These and other objects, advantages and features of the invention will be set forth in the detailed description which follows.

BRIEF DESCRIPTION OF THE DRAWINGS

In the detailed description which follows reference will be made to the drawing comprised of the following figures.

DESCRIPTION OF THE PREFERRED EMBODIMENT

Figure 1:
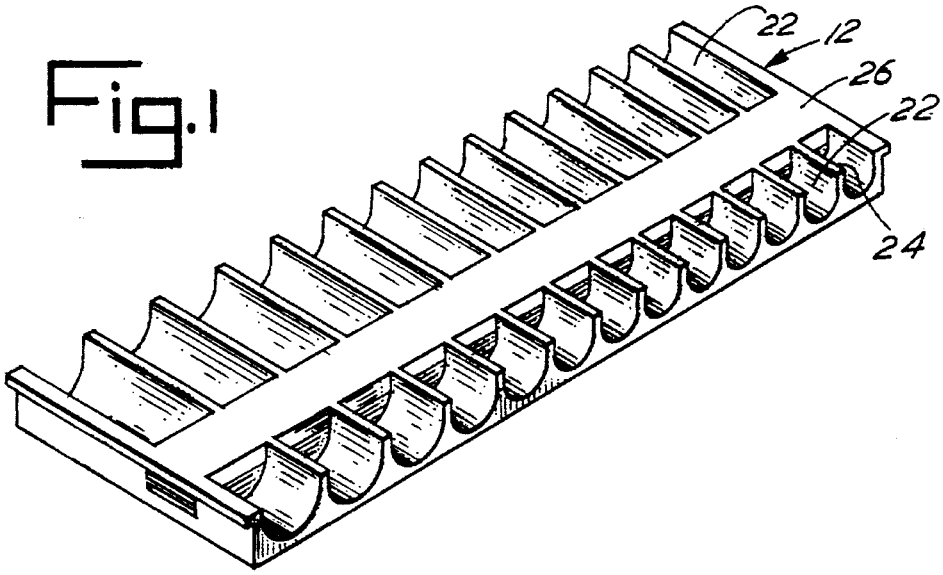
FIG. 1 is a perspective view of the improved magnetic socket holder of the invention.

Referring to the figures, the improved socket holder of the present invention is comprised of a molded tray 12 in combination with a first pole piece, armature, or keeper 14, a bar magnet 16, a second pole piece, armature, keeper plate or keeper 18 and a second bar magnet 20. The tray 12 is molded from a non-magnetic material, for example, plastic material, and includes a series of parallel troughs 22 which are separated by ridges 24 and extend transversely from a molded, hollow center rib or member 26. Each trough 22 is sized to receive magnetizable sockets having a range of dimension and shape. In a preferred embodiment of the invention, troughs 22 extend transversely from both sides of the center member 26 to accommodate sockets of various length and size and, further, to increase the capacity of the socket holder.

The magnets 16 and 20 and pole pieces 14 and 18 are fitted into a hollow, longitudinal recess 30 molded in the tray 12 along or within the center rib 26. Thus, the magnet 16 is laminated between keepers 14 and 18. Magnet 20 is attached to keeper 18. The tray 20 includes a bottom surface 32. The second magnet 20 includes a lower surface 34 which is generally coplanar with the bottom surface 32 of the tray 12.

Figure 4:
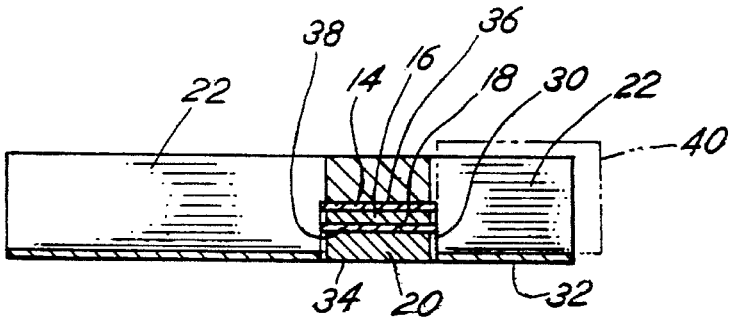
FIG. 4 is a sectional view of the socket holder of FIG. 3 taken along the lines 4—4.
Figure 5:
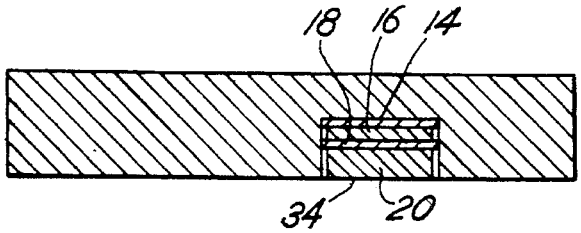
FIG. 5 is a sectional view of the holder of FIG. 3 taken along the lines 5—5; [and]

The magnet 16 includes an upper surface 36 against which the keeper 14 is positioned. The magnet 16 includes a lower surface 38 against which the keeper 18 is positioned. It is to be noted that the magnet 16 is an elongated magnet which extends the length of the tray and has a width dimension (as depicted in FIG. 4) which is slightly less than the width dimension of the keeper plates 14 and 18. This is an important feature of the preferred embodiment of the invention inasmuch as the keeper plates 14 and 18 have distinct polarity and project very slightly into each trough 22. By so projecting, the keeper plates 14 and 18 of opposite polarity cooperate and engage with each socket 40 to define a closed magnetic circuit through the socket 40. The plates 14, 18 are preferably movable or floating as described below.

Figure 6:
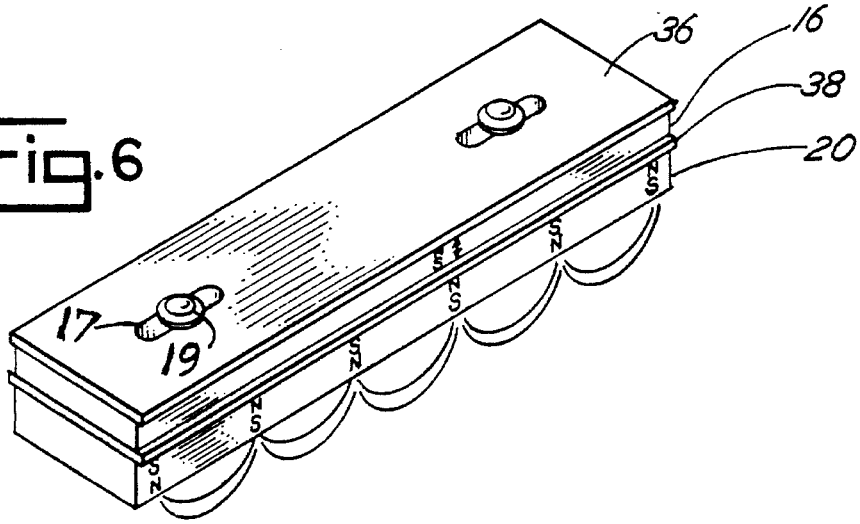
FIG. 6 is a perspective view of the configuration of the bar magnets and keeper plates or armatures incorporated with the socket holder of the invention.
Figure 2:
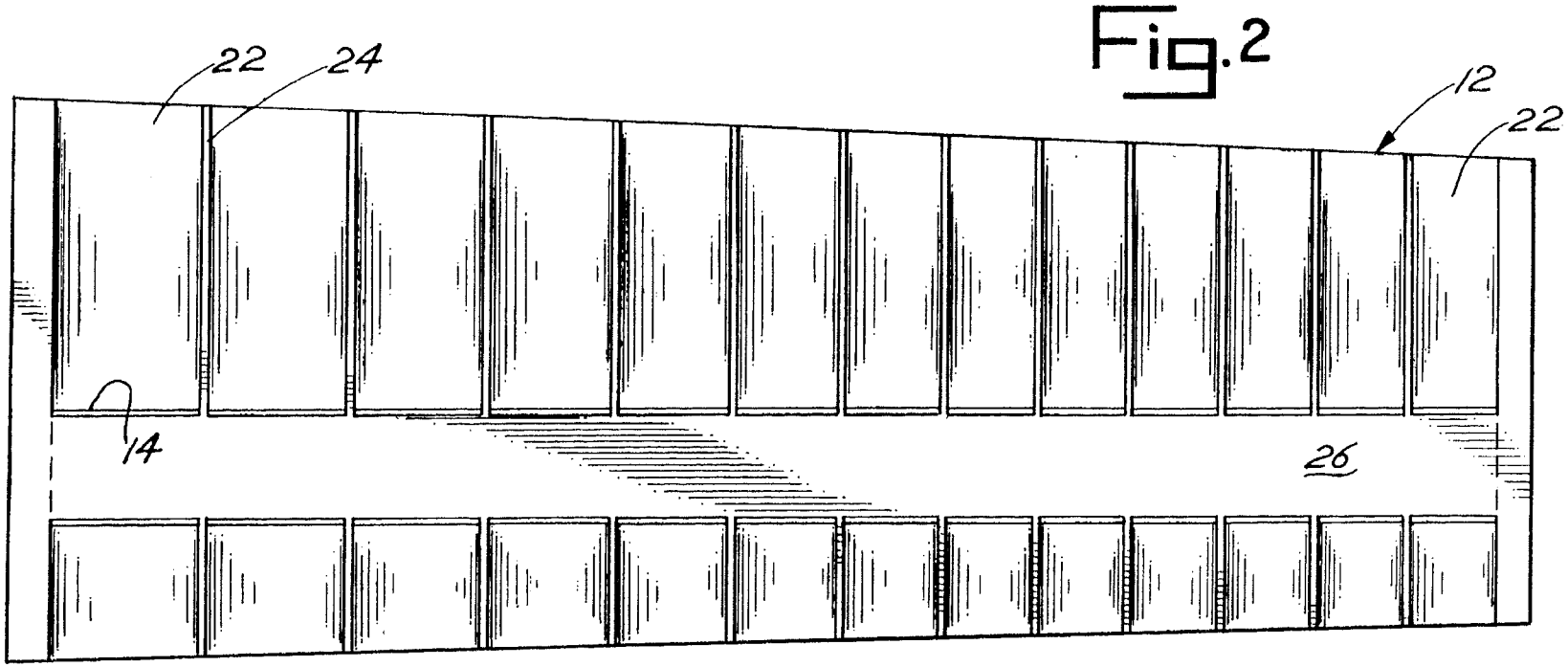
FIG. 2 is a top plan view of the socket holder of FIG. 1.
Figure 3:
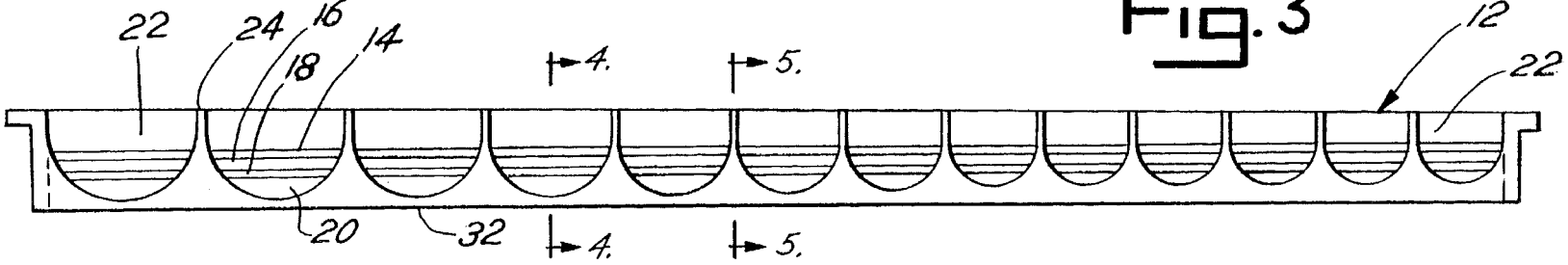
FIG. 3 is a side elevation view of the socket holder of FIG. 1.
Figure 7:
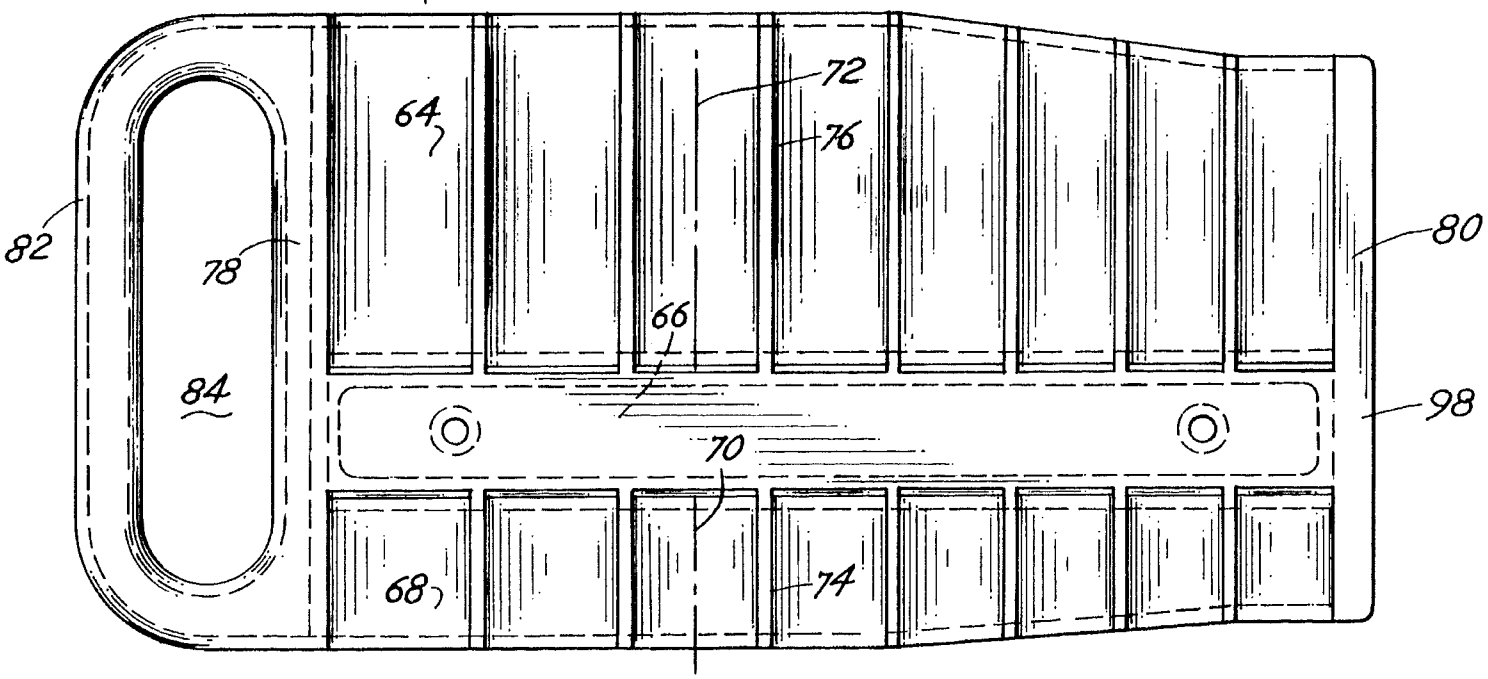
FIG. 7 is a top plan view of an alternative embodiment of the invention.
Figure 8:
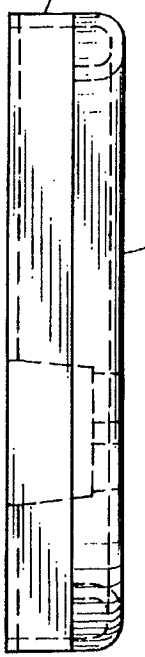
FIG. 8 is an end view of the socket holder of FIG. 7.
Figure 9:
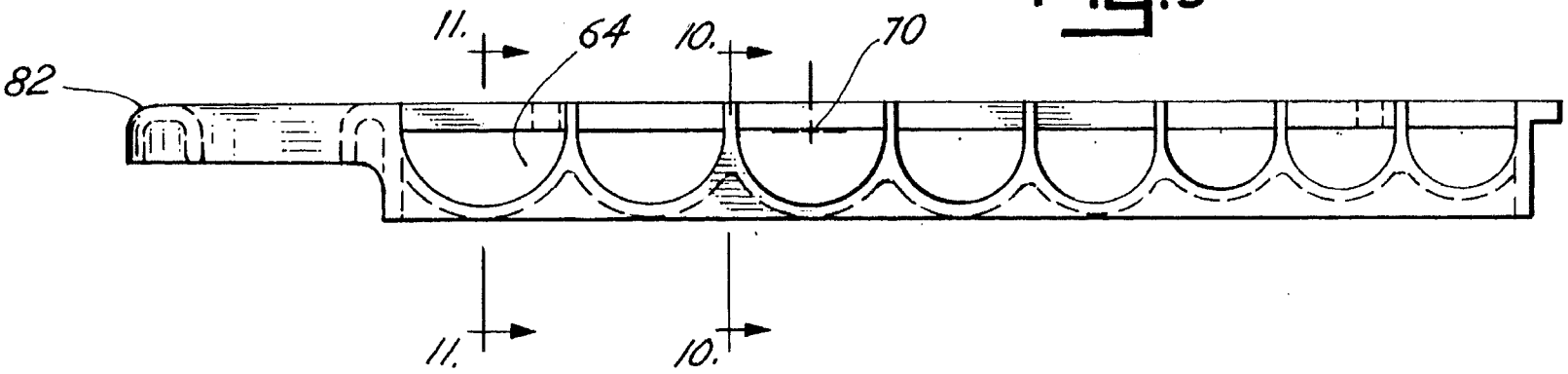
FIG. 9 is a side elevation of the socket holder of FIG. 7.

As depicted in FIG. 6, the top surface 36 of the magnet 16 has a first polarity, for example, a north pole polarity. The bottom surface 38 of the magnet 16 has a second polarity, for example a south pole polarity. The armatures or pole pieces or keeper plates 14 and 18, respectively are associated with distinct polarities. Thus when contacted with a socket, for example, socket 40 they provide for a closed magnetic circuit connecting the north and south poles which more efficiently and more effectively holds the socket 40 in position in trough 22. All of the troughs 22 and the keepers 14, 18 thus cooperate with sockets 40 in the manner described. Note one pair of keepers 14, 18 serves to cooperate with all sockets 40 in all troughs 22 on both sides of rib 26 in the preferred embodiment, though separate or segmented keepers may be utilized. Also, separate magnets, with or without keeper plates, may be used in place of the bar magnet 16.

The second magnet 20, as will be seen by reference to FIG. 6, includes a plurality of poles along the region of its bottom surface 34. Of course, a plurality of poles of opposite polarity are provided along the region of the top of the magnet 20 as depicted in FIG. 6. The pole piece 18 serves to connect or close the magnetic circuits of the magnet 20 along its top surface. The bottom surface of magnet 20 may therefore be positioned on a magnetic surface, for example a sheet metal iron surface, to complete a plurality of magnetic circuits along or with that surface. Because there are a plurality of north and south poles along the bottom surface of the magnet 20, the number of magnetic circuits and the strength of attachment of the tray and the holding force associated with holding the tray in position is greatly enhanced. The array of the polarity of the magnets 16 and 20 thus facilitates holding the sockets 40 in position as well as holding of the tray 12 onto a magnetizable surface. Multiple magnets may be substituted for the single magnet 20.

The keeper plates 14 and 18 may be loosely attached to the magnets 16 and 20 by rivets 17 which fit through slots 19 in the plates 14, 18. In this manner, the plates 14, 18 can "float" to thereby align and interact effectively with the sockets 40. Also, as suggested hereinafter, separate magnets and/or keeper plates may be provided for one or more troughs.

Another feature of the invention which has been found to be very useful is to provide a relatively rough or higher friction surface for the bottom surface 34 of magnet 20. That is, if the bottom surface 34 of magnet 20 is smooth, the socket holder or tray may tend to slide when placed on a vertical surface. Thus, the bottom surface 34 may advantageously include thereon material which enhances friction between the surface 34 and a support surface. For example, surface 34 may be etched or knurled or include a thin coating or partial coatings. A coefficient of friction in the range of 0.2 to 5.0 for surface 34 is preferred.

It is possible to vary the construction of the tray. For example, rather than having a single bar magnet running the length of the center rib 26, separate magnets and/or keepers may be associated with each of the troughs 22. Similarly, separate magnets may be utilized in place of the bar magnet 20. Additionally, the magnetic material used to manufacture the magnets 16 and 20 may be varied. For example, it may be a composite manufacture the magnets 16 and 20 may be varied. For example, it may be a composite elastomeric material such as taught in U.S. Pat. No. 4,591,817 referenced above. Magnets 16 and 20 may be replaced by a single magnet. The magnet 20 may be omitted. The array of the troughs 22 may also be varied. It is an object of the invention, however, to enhance the holding power with respect to sockets 40 by means of completing magnetic circuits in a desirable fashion.

FIGS. 7–11 illustrate an alternative embodiment of the invention. The alternative embodiment incorporates a handle that is molded integrally with the socket tray. Thus referring to the FIGS. 7–11, a tray 62 includes a plurality of molded parallel troughs 64 arranged side by side along one side of a molded channel 66. The channel 66 is adapted to receive a magnet and pole pieces as described below. A second array of molded parallel troughs 68 is arranged along the opposite side of the longitudinal channel 66. Each of the troughs 64 and 68 are generally parallel to one another and are defined by generally cylindrical axes such as axis 70 in FIG. 9 for trough 68 and axis 72 for trough 64. In the preferred embodiment, the axis 70 of trough 68 is coaxial with axis 72 of trough 64.

The depth of each trough is preferably slightly greater than the radius of a socket which fits therein but less than the diameter of such a socket. The troughs are separated by ribs, for example ribs 74 separate troughs 68 and ribs 76 separate the troughs 64. The channel 66 extends longitudinally along one side of the troughs 64 and 68 and is open to the end of those troughs 64 and 68 as illustrated in FIG. 11.

The tray 62 has opposite ends 78 and 80. A handle 82 is integrally molded with tray 62 at end 78. The handle 82 is generally parallel to the troughs 64 and 68 and abuts the end of the channel 66 as well as extends along the length of the troughs 64 and 68. The handle 82 is spaced from the end 78 to define an opening 84 into which one may insert a hand in order to appropriately grasp the handle 82.

Figure 10:
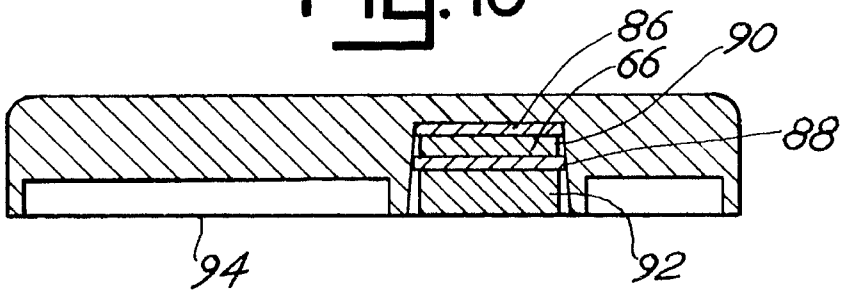
FIG. 10 is a sectional view of the holder of FIG. 9 taken along the line 10—10.
Figure 11:
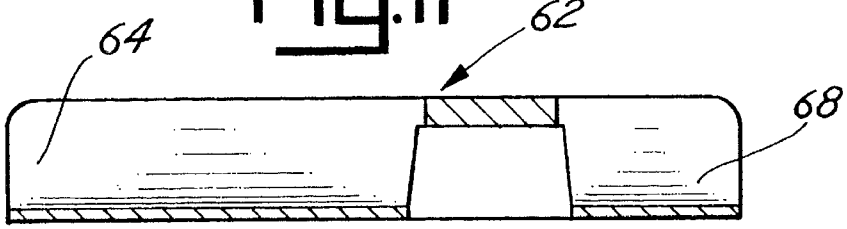
FIG. 11 is a sectional view of the holder of FIG. 9 taken along the line 11—11.

As shown in FIGS. 10 and 11, pole pieces 86 and 88 are laminated with a first magnet 90 and project into the ends of troughs 64 and 68 to define a pathway for a magnetic circuit in cooperation with sockets in the troughs 64 and 68. A second magnet 92 is provided flush with the lower surface 94 of the tray 62. The construction or arrangement of the magnets 90 and 92 and pole pieces 86 and 80 is the same as previously described with respect to the first embodiment of FIGS. 1–6.

A stiffening and protective flange 98 is arranged at the opposite end of tray 62 from handle 82. The troughs 64, 68 and handle 82 are generally coplanar with one another.

The construction may be varied. For example, a handle may be positioned along each end of the tray. A handle may be positioned along one or both sides of the tray, or on the top of the tray along rib 26, for example. The depth of the troughs may be varied. The pattern of the troughs may be varied. For example, rather than having the axes 70, 72 of the troughs 64 and 68 aligned, those axes 70, 72 may be offset with respect to each other. Thus while there have been set forth the preferred embodiments of the invention, the invention is only to be limited by the following claims and their equivalents.

What is claimed is:

1. An improved magnetic socket holder comprising, in combination:

a molded socket tray including a mounting surface, opposite ends, a tray cross member connecting the ends, a plurality of parallel troughs arrayed between the ends along at least one side of the cross member and extending from the tray cross member, each adjacent parallel trough being laterally separated from the next adjacent parallel trough, said tray cross member defining a magnet support channel which is open to an end of each trough;

at least one magnet mounted in the support channel, said magnet exposed to at least one trough at the end open to the cross member, said magnet including a first region of one polarity and a second region of another polarity, said magnet positioned in the channel so as to magnetically interact with a magnetizable metal socket in the trough to complete a magnetic circuit between the regions with said socket.

2. The holder of claim 1 further including a first keeper plate in the channel adjacent the first region of the magnet and a second keeper plate adjacent the second region, said plates projecting into the trough to mechanically engage a socket in the trough and complete a magnetic circuit.

3. The holder of claim 2 wherein the keeper plates are movable relative to the magnets.

4. The holder of claim 1 including a handle molded integrally with the socket tray.

5. An improved magnetic socket holder comprising, in combination:

a non-magnetic material tray having opposite ends, a plurality of generally parallel troughs, the top of each trough being open to receive a socket, said tray further including a transverse magnet support channel abutting one end of each trough, said channel being open at said one end of each trough;

a first magnet in the magnet support channel, said first magnet having a top surface, a bottom surface, said first magnet extending across the one end of at least one trough, said first magnet having one pole along the top surface and another pole along the bottom surface;

a pole piece for the top surface of the first magnet positioned at the open end of the trough; and a separate pole piece for the bottom surface of the first magnet positioned at the open end of the trough.

6. The socket holder of claim 5 including a second magnet in the support channel abutting a pole piece and further including a bottom face positioned in a mounting surface of the socket holder, said bottom surface of the second magnet defining a plurality of poles along the length of the second magnet whereby the holder may be mounted on a magnetizable surface.

7. The socket holder of claim 5 including friction means on the bottom surface.

8. An improved magnetic socket holder comprising, in combination:

a non-magnet material tray having opposite ends, a plurality of generally parallel troughs, the top of each trough being open to receive a socket, said tray further including a transverse magnet support channel abutting one end of each trough;

an integrally molded handle in the tray at one of the said opposite ends;

the first magnet in the magnet support channel, said first magnet having a top region and a bottom region, said first magnet extending across the one end of at least one trough, said first magnet having one pole along the top region and another pole along the bottom region;

a pole piece for the top surface of the first magnet;

a separate pole piece for the bottom surface of the first magnet; and a second magnet in the support channel abutting the separate pole piece and further including a bottom face positioned in a mounting surface of the socket holder, said bottom surface of the second magnet providing a plurality of poles along the length of the second magnet whereby the holder may be mounted on a magnetizable surface.

* * * * *